United States Patent [19]

Evans et al.

[11] 4,253,003

[45] Feb. 24, 1981

[54] HIGH VOLTAGE SWITCH OPERATING MECHANISM

[75] Inventors: David M. Evans, Palatine; Edward J. Rogers, Chicago, both of Ill.

[73] Assignee: S & C Electric Company, Chicago, Ill.

[21] Appl. No.: 911,123

[22] Filed: May 31, 1978

[51] Int. Cl.[2] ..... H01H 3/32

[52] U.S. Cl. ..... 200/153 SC; 335/76

[58] Field of Search ..... 335/76; 260/153 SC

[56] References Cited

U.S. PATENT DOCUMENTS

| | | | |
|---|---|---|---|
| 2,822,445 | 2/1958 | Schindler et al. | 335/76 |
| 2,846,622 | 8/1958 | Miller et al. | 335/76 |
| 3,980,977 | 9/1976 | Evans | 335/76 |

*Primary Examiner*—Steven L. Stephan

*Attorney, Agent, or Firm*—Kirkland & Ellis

[57] ABSTRACT

Disclosed is an improved high voltage switch operating mechanism which utilizes energy stored in a spiral spring to drive high voltage switches from either the open to the closed position or the closed to the open position. A spiral spring interconnects a rotatably mounted drive lever, which can be rotated to charge the sprial spring, and an output lever, which drives the switch either open or closed when the switch operating mechanism is tripped. A gearbox assembly reduces the torque required to charge the spiral spring when supplied either manually with a crank or electrically through a motor. The output lever is held in the switch-closed or the switch-opened position by improved first or second output lever latch assemblies, respectively, while the drive lever is rotated to charge the spring. Once the spiral spring is charged, first and second main latches engage the drive lever holding it in a spring charged position. The switch operating mechanism is tripped by releasing first or second output lever latch assemblies, which can be released manually by a single trip handle or by solenoids connected to control circuitry. When tripped, the spiral spring reacts against the output lever to either open or close the switch depending on the position of the switch at the initiation of the operation. After a switching operation is completed, the spring can be recharged for the next operation. Manual and electrical trip interlock assemblies are provided to prevent the switch operating mechanism from being tripped either manually or electrically while the spiral spring is being recharged either manually or electrically.

16 Claims, 17 Drawing Figures

13
12
A
125
B
103
106
108
162
104
166
110
102
124
116

308
118
126
120
127
336
338
122
342
334
344
32
112
352
340
100
220
200
129
C
355
202
618
346
222
204
300
36
302
312
381
622
620
305
304
34
30
38
40
614
24
510
26
22
20
18
16
578
14
15
306
A
10
B
C

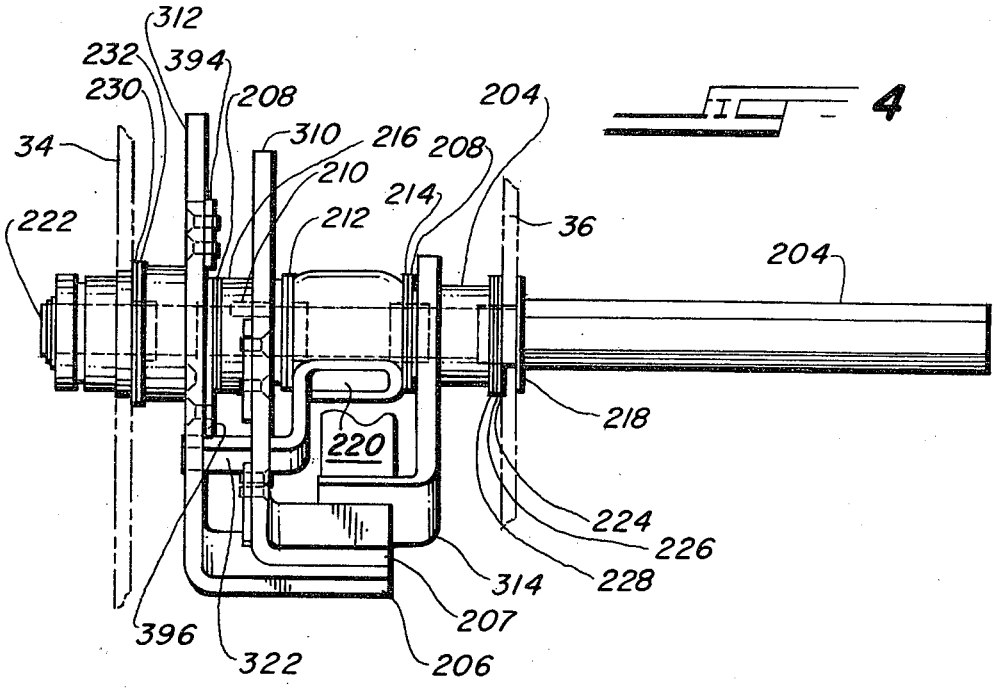
312
232
394
230
208
204
4
34
310
216
208
210
214
222
212
36
204
218
220
224
226
228
314
207
396
322
206

202
618
204
626
628
203
624
630
620
400
614
572
636
574
582
580
584
586
590
610
608
586
638
582
596
578
14

126
125
124
104
154
156
115
158
146
160
168
103
108
106
114
113
107
117
166
164
162
150
152
110
148
158
120
140
136
116
136
138
142
118
144
127
122
132
134
130
132
128
129
32

HIGH VOLTAGE SWITCH OPERATING MECHANISM

BACKGROUND OF THE INVENTION

1. Field of the Invention

The present invention relates to mechanisms for operating high voltage switches, and more particularly, to a spiral spring operated mechanism which may be charged either manually or electrically and which may be operated or controlled either manually or electrically to perform both opening and closing switch operations.

2. Description of the Prior Art

The present invention constitutes an improvement over the construction disclosed in U.S. Pat. No. 3,980,977-Evans, entitled "SPIRAL OPERATING MECHANISM FOR HIGH VOLTAGE SWITCH," issued on Sept. 14, 1976, and assigned to the same assignee as the present invention. That patent discloses a spiral spring operating mechanism that can be recharged either manually or by motor and which can be controlled or operated either manually or electrically to both open and close high voltage switches. However, the mechanism disclosed in Evans has the disadvantage of requiring a clutch mechanism to disengage the motor while the spiral spring is being recharged manually. The present invention eliminates the necessity for such a clutch mechanism.

Another disadvantage of the mechanism disclosed in Evans is that it required a significant amount of torque to recharge the spiral spring. The present invention overcomes this disadvantage by providing a gearbox assembly to reduce the torque required to recharge the spiral spring. The lower torque requirement allows a smaller electric motor to be used for recharging the spiral spring, facilitates manual recharging, and lessens the mechanical stress exerted on members of the operating mechanism during recharging.

Additionally, it is desirable to avoid inadvertent tripping of the operating mechanism while the spiral spring is being recharged because such an inadvertent tripping would result in incomplete operation of the associated high voltage switch or its operation at too slow a speed. Such improper operation could cause a failure of the high voltage switch to properly interrupt the circuit or a failure to properly close the switch in the event a short circuit exists on the circuit being energized. Although the mechanism disclosed in Evans provides a shutter bolt that prevents tripping either electrically or manually during manual recharging, the Evans mechanism did not provide a means to prevent tripping while the device is being charged electrically. The present invention, however, provides means for preventing both electric and manual tripping not only during manual recharging, but also while the mechanism is being charged electrically through the motor.

Finally, the switch operating mechanism disclosed in Evans required a separate trip handle to control tripping to close and tripping to open the associated high voltage switch.

Thus, the prior art switch operating mechanism disclosed in Evans does not provide a gearbox assembly to reduce the torque required to recharge the spiral spring. Further, the prior art mechanism does not provide a simple means for releasing the output lever by pivoting a single trip handle right or left to open or close the associated high voltage switch. In addition, in Evans a clutch mechanism was required to disconnect the motor from the mechanism during manual recharging of the spiral spring. Finally, Evans does not disclose a means for preventing automatic tripping while the mechanism is being recharged by the motor.

BRIEF DESCRIPTION OF THE INVENTION

An improved mechanism for operating a switch between opened and closed and between closed and opened positions in accordance with the present invention comprises a rotatably mounted output lever operably connected to the switch. A drive lever is rotatably mounted about the same axis as the output lever. A spiral spring is coaxially positioned with respect to the drive and output levers and interconnects the drive and output levers. First and second output latch assemblies are provided for releasably holding the output lever in the switch-opened and switch-closed positions, respectively. A charging means is provided connected to the drive lever for rotating the drive lever in a first direction to charge the spiral spring for switch opening operations and in a second direction for charging the spring for switch closing operations. A first main stop latch is provided for engaging and holding the drive lever in a spring-charged position ready for switch-closing operations when the spiral spring biasing means rotates the output lever in the first direction. A second main stop latch is provided for engaging and holding the drive lever in a spring-charged position ready for switch opening operations when the spiral spring biasing means rotates the output lever in the second direction. First output lever latch assembly means is provided for releasing the output lever so that the output lever will pivot under the biasing of the spiral spring to open the switch. Second output lever latch assembly means is provided for releasing the output lever so that the output lever will pivot under the biasing of the spiral spring to close the switch.

The charging means for charging the spiral spring may comprise an electric motor that is automatically controlled depending upon the positional relationship of the drive lever and the switch to either charge the spring for switch opening or closing as required. Alternatively, the charging means may comprise a manually-operated crank which is inserted into the mechanism and cranked to manually charge the spiral spring in the desired direction.

Both the electric motor and the manually operated crank drive a gearbox assembly which reduces the torque input required to rotate the drive lever to charge the spiral spring. The gearbox assembly also prevents the application of excessive torque to the charging means or to the spiral spring which could otherwise develop at the end of the charging cycle when the drive lever is rotated to its limit or if the manually-operated crank is operated in the wrong direction. The gearbox assembly also eliminates the need for a brake to slow the electric motor at the end of the charging cycle.

As a third alternative, a variation of the preferred embodiment of the present invention does not include a gearbox assembly but utilizes instead the charging means comprising a lever handle which is inserted into the mechanism to facilitate manual charging by providing a longer lever arm than the manually-operated crank.

First and second output lever latch assemblies may be actuated to release the output lever in response to electrical control signals by first and second solenoids operably connected to first and second output lever latch assemblies, respectively. Alternatively, first and second output lever latch assemblies may be actuated to release the output lever by manual operation of a single trip lever operably connected to both first and second output lever latch assemblies.

Inadvertant release of the output lever while the spiral spring is being charged could result in incomplete operation of the associated switch or its operation at too slow a speed to properly interrupt the high voltage circuit or to properly close the switch in the event a short circuit existed on the circuit being energized. Therefore, it is desirable to provide a manual trip interlock means to prevent manual tripping of the output lever latch assemblies during charging of the spiral spring and an electrical trip interlock means to prevent electrical tripping of the output lever latch assemblies during charging of the spiral spring. Accordingly, an interlock disk is provided which prevents the manual trip lever from being rotated to cause first or second output lever latch assemblies to release the output lever while the spiral spring is being charged. Also provided are first and second electrical switches which deactivate first and second solenoids, respectively, and thereby prevent second and first output lever latch assemblies, respectively, from releasing the output lever while the spiral spring is being charged.

In a variation of the present invention, all features of the preferred embodiment of the present invention are provided except the motor charging means, the manually-operated crank charging means, and the gearbox assembly. In this embodiment of the present invention the spiral spring is charged by pivoting it with a lever directly.

It is a primary object of the present invention to provide an operating mechanism for high voltage switches utilizing an improved latch tripping mechanism which may be released by an electro-mechanical control or by a mechanical control to release the spiral drive spring to cause the high voltage switch to open or close.

It is another object of the present invention to provide an improved operating mechanism for high voltage switches in which the first and second output lever latch assemblies which release the energy stored in the spiral spring for operating the high voltage switches are prevented from being released either manually or electrically during both manual and electric charging of the sprial spring.

It is another object of the present invention to provide an improved operating mechanism for high voltage switches in which a gearbox assembly reduces the torque required to recharge the sprial spring either manually or electrically and in which no clutch mechanism is required to disengage the motor during manual recharging.

These and other objects, advantages, and features will hereinafter appear, and for the purposes of illustration, but not of limitation, exemplary embodiments of the present invention are illustrated in the accompanying drawings.

DESCRIPTION OF THE DRAWINGS

FIG. 4 is a cross-sectional partially fragmentary view of the spiral spring mechanism of the present invention taken in the direction of line D—D in FIG. 3.

DETAILED DESCRIPTION OF THE PREFERRED EMBODIMENTS

Figure 1:
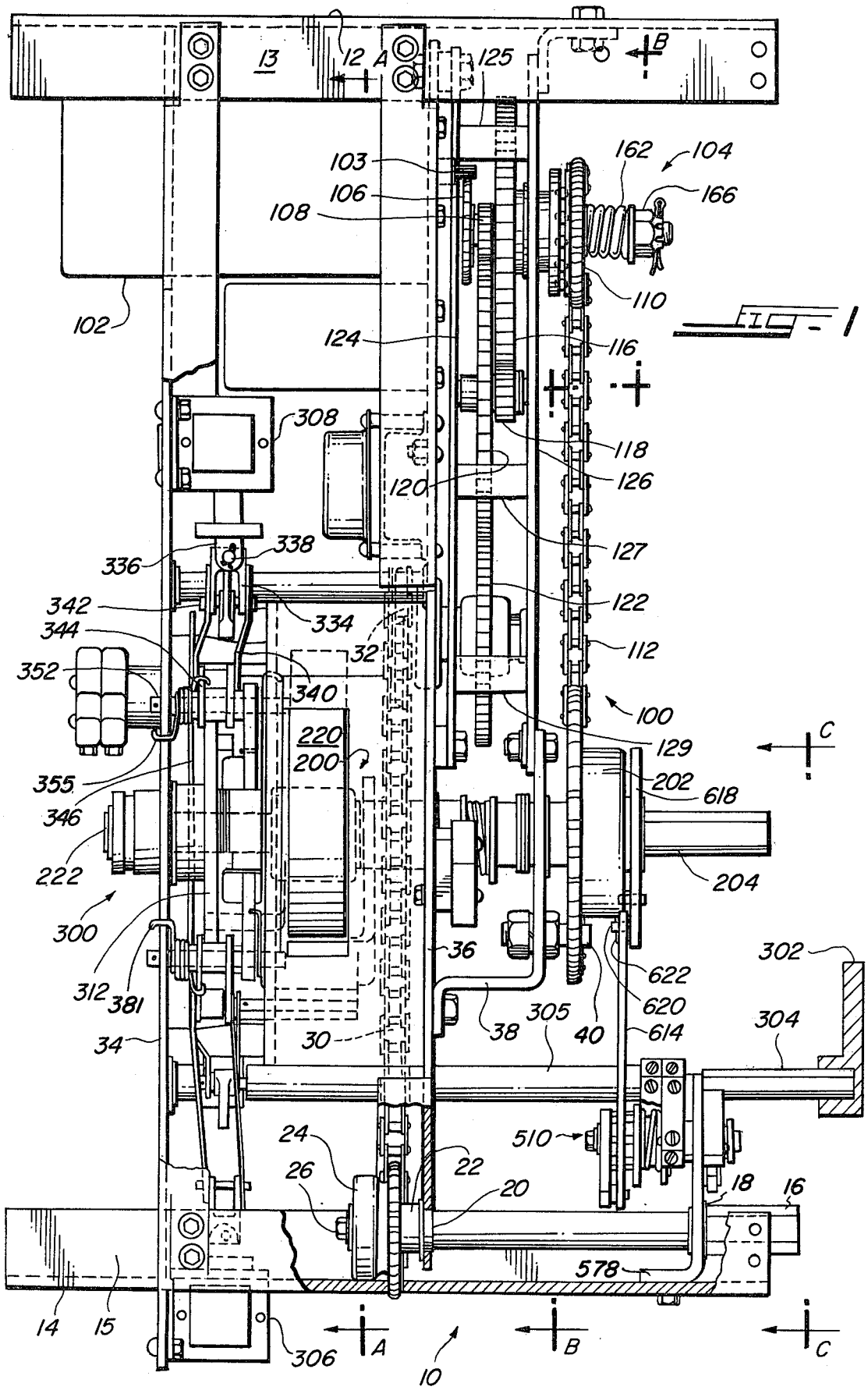
FIG. 1 is a side elevational view of the preferred embodiment of the present invention.
Figure 17:
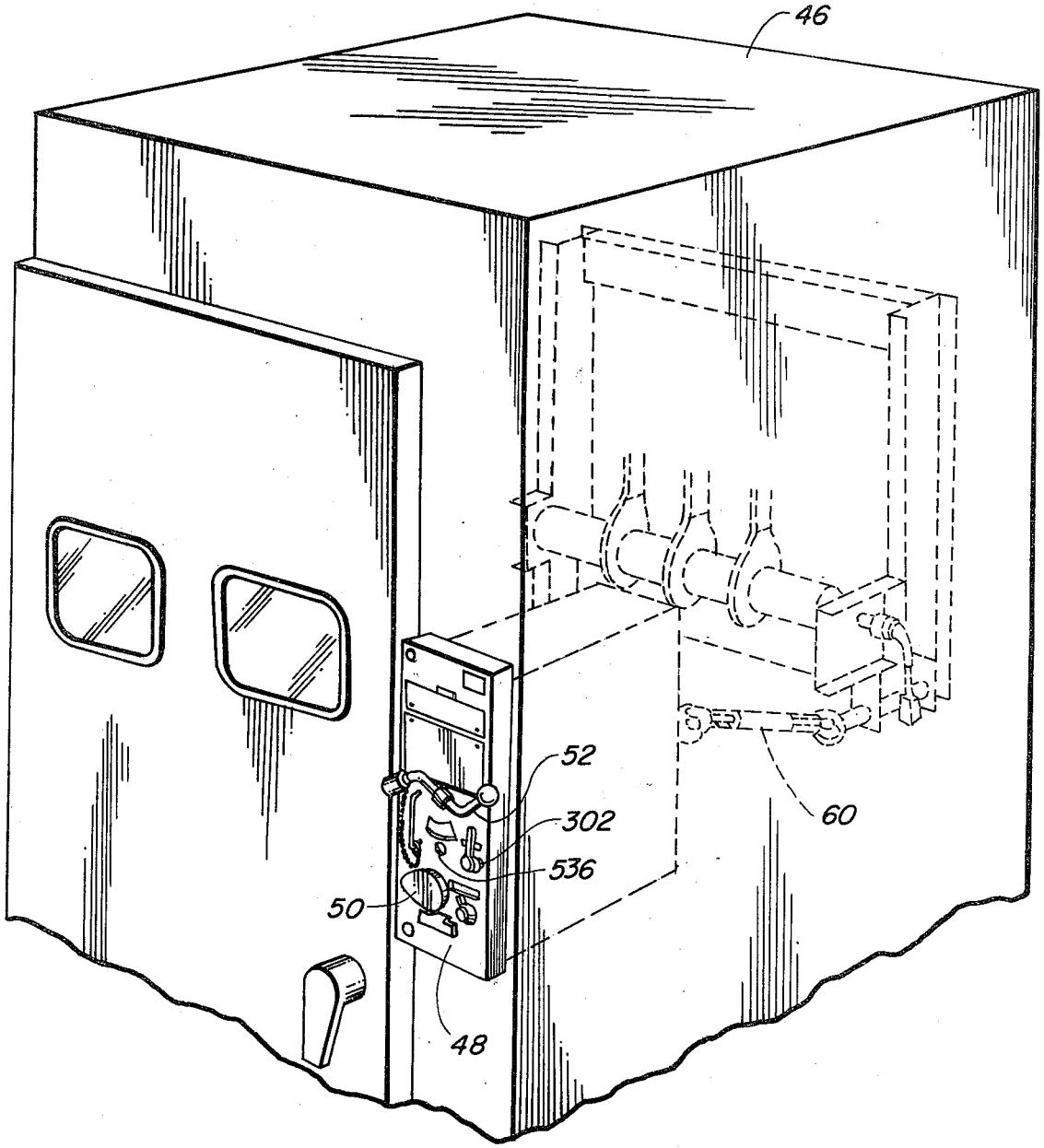
FIG. 17 is a perspective view of a preferred embodiment of the present invention showing the linkage between the present invention and the high voltage switch.

Referring to FIG. 1, switch operating mechanism 10 is mounted on top frame angle 12 and bottom frame angle 14, both of which are fastened to the inside wall of metal enclosure 46 (see FIG. 17). Suitably mounted to top frame angle 12 and bottom frame angle 14 are center channel 36 and rear channel 34. Hand crank shaft 16 is supported by bushing 18 in mounting bracket 578 and by bushing 20 in center channel 36. Sprocket 24 is spaced from center channel 36 on crank shaft 16 by spacer 22 and is fastened to crank shaft 16 by nut 26 and a square key (not shown) so that sprocket 24 rotates conjointly with crank shaft 16. Roller chain 30 transmits the rotation of hand crank shaft 16 to sprocket 32 of gearbox assembly 100, which connects to spiral spring 220 and which is discussed in greater detail below. Crank shaft 16 is manually operated to charge spiral spring 220 by crank handle 52 (shown in FIG. 17). Crank handle 52 is shown in the stowed position in FIG. 17. Crank handle 52 is operably placed over the hexagonal end of crank shaft 16 by pivoting shutter 50 away from opening 54 in control panel 48.

Motor 102 also can be used to drive gearbox assembly 100. Torque limiter assembly 104 prevents the application of excessive torque to spiral spring assembly 200 or to latch trip assembly 300 by limiting the torque transmitted from sprocket 110 to sprocket 202 by roller chain 112. Sprocket 202 is rigidly mounted to main shaft 204, which transmits energy to spiral spring 220, and turns conjointly with main shaft 204. Sprocket stop stud 40 is suitably mounted on U-bracket 38 and extends through arcuate slot 203 in sprocket 202 (see FIG. 11) thereby limiting the rotation of sprocket 202.

Spiral spring 220 stores the energy supplied by motor 102 or manually by crank handle 52 until a switching operation is required. Latch trip assembly 300 (see FIG. 3) prevents the energy stored in spiral spring 220 from being released until tripped manually by rotation of trip handle 302 on shaft 304 or electrically by actuation of second solenoid 306 or first solenoid 308, as will be discussed in greater detail below. Output lever 312 is rigidly mounted on one end of output shaft 222, and output lever 312 rotates conjointly with output shaft 222. When the energy which has been stored in spiral spring 220 is released, it causes output lever 312 and output shaft 222 to rotate rapidly through a predetermined angular rotation, either clockwise or counterclockwise. Output shaft 222 is operably coupled to the high voltage switches to be operated (not shown) by switch drive linkage means comprised of either rotating drive shaft 60 (see FIG. 17) or a reciprocating linkage in the form of a cable (not shown), which causes the high voltage switches to be opened when output shaft 222 rotates in a first direction and to be closed when output shaft 222 rotates in a second direction. A coupling mechanism suitable for coupling output shaft 222 to switch drive linkage means is described in the co-pending patent application entitled "Switch Operator Uncoupling Mechanism," Ser. No. 911,124, filed May 31, 1978, and assigned to the same assignee as the present invention. Switches typical of the high voltage switches that can be operated by the present invention are described in U.S. Pat. No. 3,563,102—Bernatt, et al., issued Feb. 16, 1971, and in U.S. Pat. No. 3,980,977—Evans, issued Sept. 14, 1976, both of which are assigned to the same assignee as the present invention.

Figure 12:
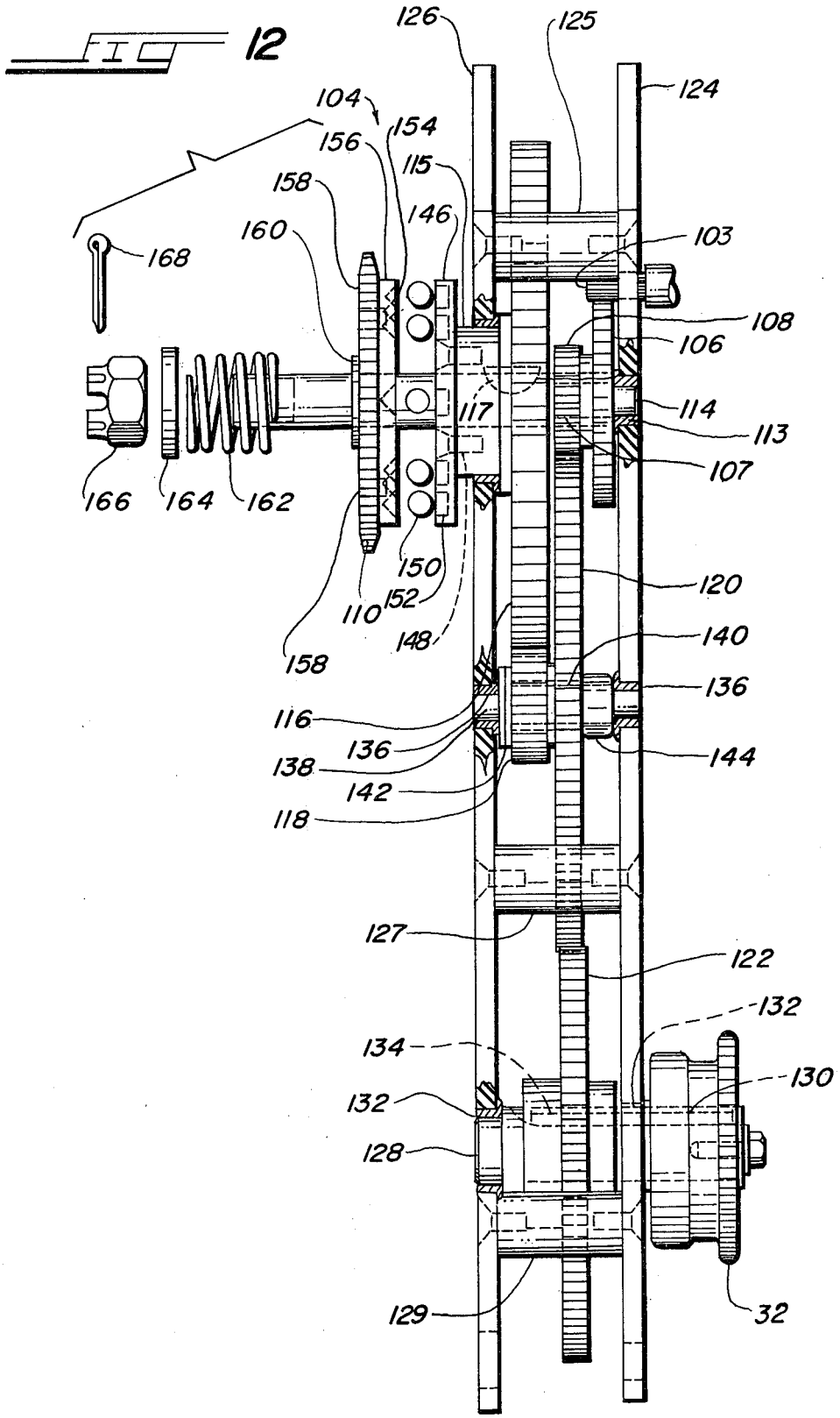
FIG. 12 is a side elevational view of the gearbox assembly of the present invention.
Figure 13:
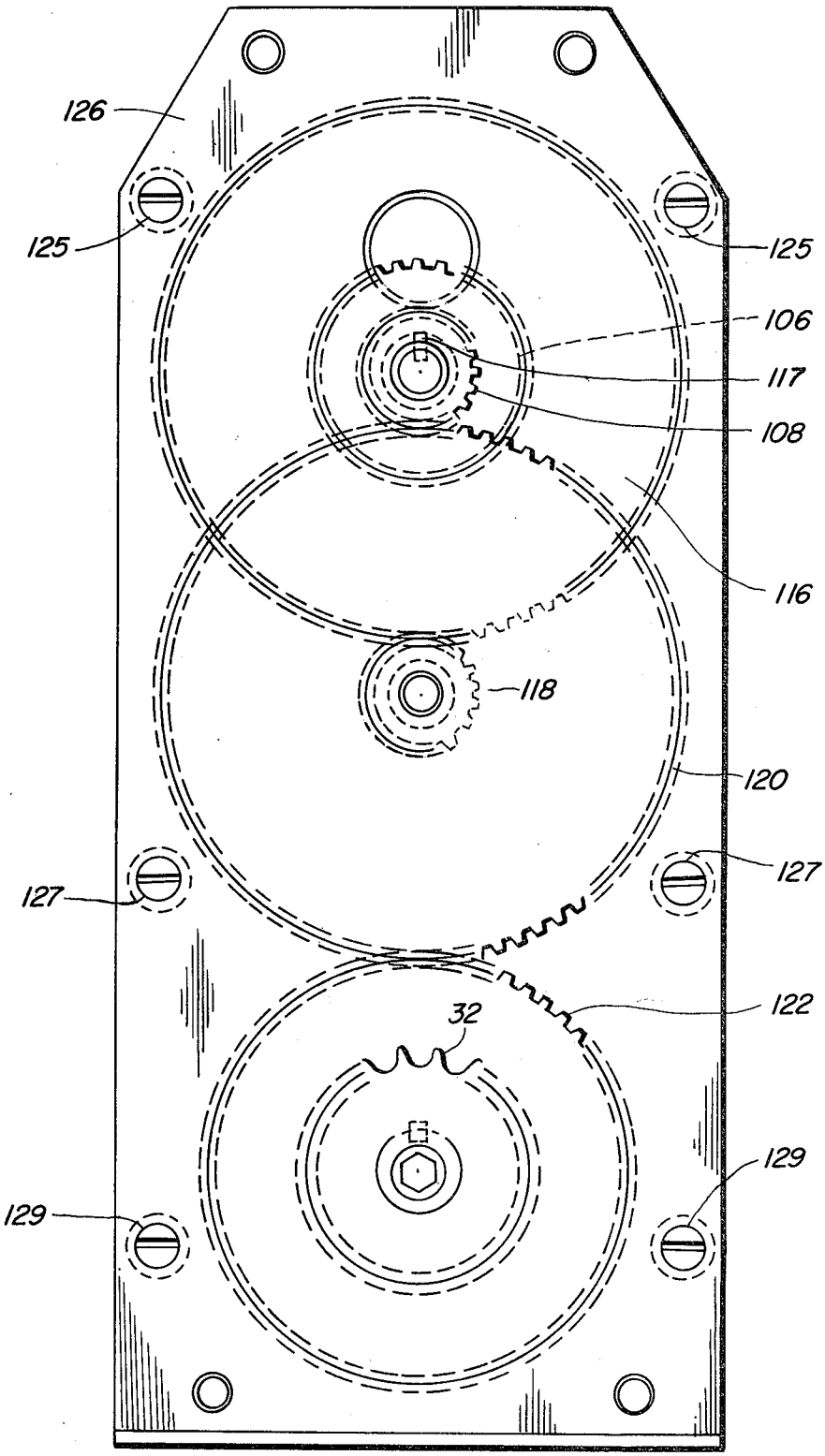
FIG. 13 is a cross-sectional view of the gearbox assembly of the present invention.

With reference to FIGS. 12 and 13, gearbox assembly 100 is comprised of spur gear 106 and pinion 108, which rotate conjointly, pinion 118 and gear 120, which rotate conjointly, gear 116, and gear 122. The diameters of spur gear 106, pinion 108, gear 116, pinion 118, gear 120 and gear 122 are suitably chosen to reduce the torque required from manually-operated crank 52 or motor 102 to charge spiral spring 220. Gearbox assembly 100 is mounted between bearing plates 124 and 126, which are supported by spacers 125, 127, and 129. Bearing plate 124 is suitably secured to center channel 36 and bearing plate 126 is suitably secured to U-bracket 38 and to top frame angle 12. Sprocket 32 is mounted on shaft 128 and fastened by square key 130 so that sprocket 32 and shaft 128 rotate conjointly. Shaft 128 is supported by bushings 132 in bearing plates 124 and 126. Spur gear 122 is fastened to shaft 128 by square key 134.

Spur gear 122 meshes with gear 120. Bushings 136 which are pressed into bearing plates 124 and 126 support shaft 138 and allow it to rotate freely therein. Bearing 140 is pressed into gear 120 and pinion 118, which conjointly rotate freely on shaft 138. Thrust washers 142 and spacer 144 maintain pinion 118 and gear 120 in the proper position on shaft 138. Pinion 118 meshes with gear 116 and gear 120 meshes with pinion 108. Spur gear 106 meshes with motor pinion 103. Spur gear 106 and pinion 108 are pressed onto bearing 107 so that they conjointly rotate freely on shaft 114. Shaft 114 is supported in bearing plate 124 by bushing 113 and in bearing plate 126 by bushing 115. Gear 116 is fastened to shaft 114 by woodruff key 117 so that shaft 114 rotates conjointly with gear 116. Torque plate 146 is fastened to bushing 115 on shaft 114 by screws 148. Hardened steel balls 150 ride in bores 152 in torque plate 146 and in shallower counter bores 154 in torque plate 156, balls 150 thus being located circularly between torque plates 146 and 156. Sprocket 110 is fastened to torque plate 156 by screws 158. Bushing 160 is pressed into sprocket 110 so that sprocket 110 rotates freely on shaft 114 except when torque plate 156 is held firmly against torque plate 146 with steel balls 150 between them. When torque plates 146 and 156 are pushed together with sufficient force, rotation of torque plate 146 causes rotation of torque plate 156 due to the force exerted on the sides of counter bores 154 by steel balls 150. Torque plate 146 is biased against torque plate 156 by spring 162 which is held on shaft 114 between sprocket 110 and flat washer 164 by castellated nut 166, which is threaded onto the end of shaft 114. By tightening nut 166 against washer 164 and spring 162, the spring bias holding torque plate 156 against steel balls 150 and torque plate 146 is increased. Cotter pin 168 fits through castellated nut 166 and shaft 114 to prevent the bias of spring 162 from causing nut 166 to rotate on its threads and to thereby decrease the bias of spring 162.

Torque limiter assembly 104 serves to limit the torque applied to sprocket 110 and to spiral spring assembly 200, since if the torque applied by gear 116 through torque plate 146 is sufficiently great, steel balls 150 will overcome the bias of spring 162 and roll out of shallow counter bores 154 in torque plate 156, thus causing torque plate 156 and attached sprocket 110 not to rotate with torque plate 146.

Gearbox assembly 100, therefore, transmits rotation of manually-operated crank 52 and crank shaft 16 to main shaft 204 of spiral spring assembly 200. Rotation of sprocket 24 is transmitted to sprocket 32 by chain 30. Rotation of sprocket 32 is transmitted to spur gear 122 via shaft 128. Rotation of spur gear 122 is transmitted to gear 120, since gear 120 meshes with spur gear 122. Shaft 138 transmits rotation of gear 120 to pinion 118 which meshes with gear 116 and thereby transmits the rotation to shaft 114. Rotation of shaft 114 is transmitted to sprocket 110 by torque limiter assembly 104. When motor 102 is used to charge spiral spring 220, motor pinion 103 drives spur gear 106 which rotates conjointly with pinion 108. Pinion 108 then drives gear 120, with the remaining portions of gearbox assembly 100 functioning the same as for manual crank charging. During manual crank charging, motor pinion 103 turns idly and during charging by motor 102, crank shaft 16 turns idly.

Figure 3:
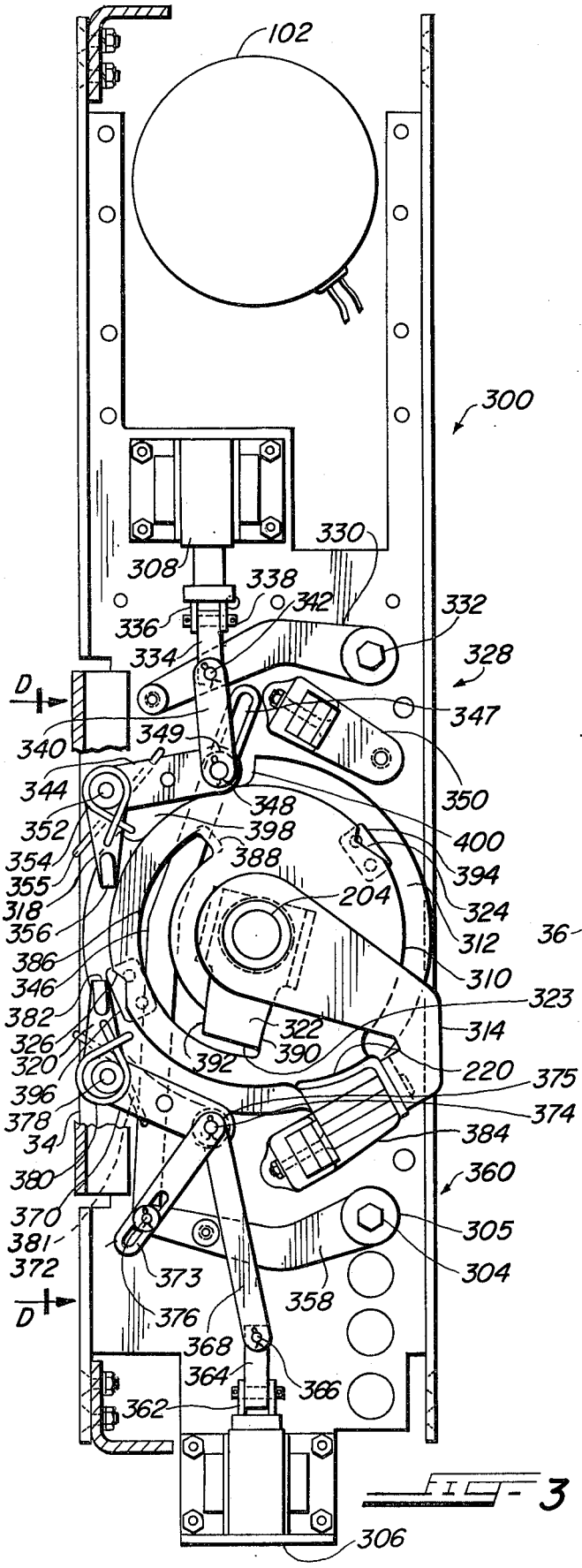
FIG. 3 is a cross-sectional view taken substantially along line A—A in FIG. 1.
Figure 5:
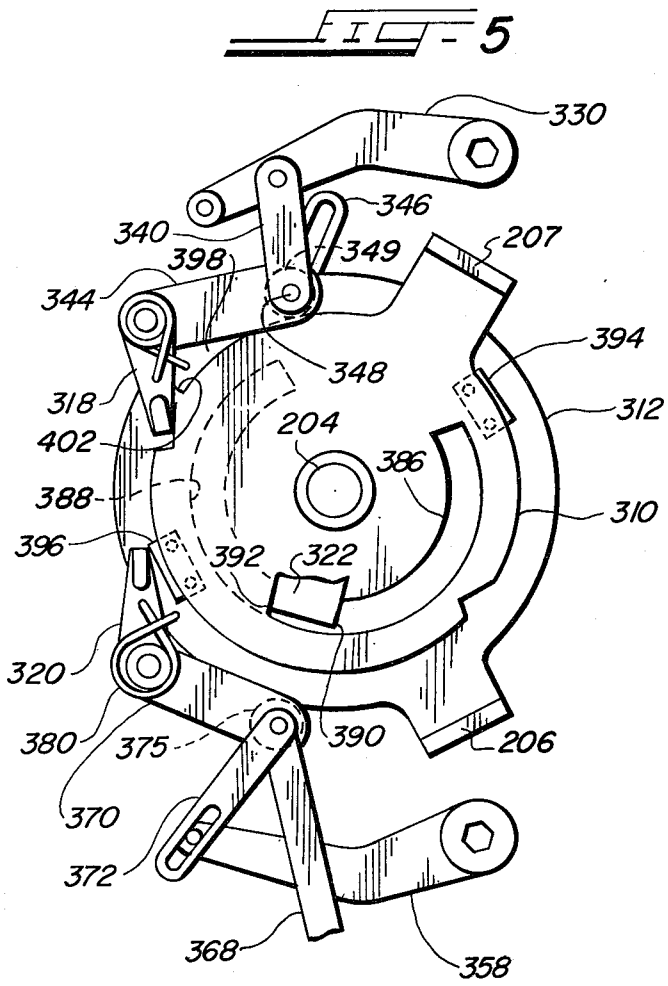
FIG. 5 is a cross-sectional partially fragmentary view taken substantially along line A—A in FIG. 1 showing the output lever and the drive lever in the spring-charged position ready for a switch closing operation.

In FIG. 3 latch trip assembly 300 is shown in the spring discharged position with the switch open. First actuating lever 330 of first output lever latch 328 is pivotably mounted on shaft 332. Coupler 334 is fastened to actuating member 336 of first solenoid 308 by pin 338. The upper end of first link 340 is pivotably fastened to coupler 334 and actuating lever 330 by pin 342. The lower end of first link 340, first roller arm 344, and interconnecting link 346, are pivotably fastened by pin 348. First roller 349 rotates freely about pin 348 and is engagable with surface 400 of notch 398 in output lever 312. The other end of first roller arm 344 is pivotably mounted to first main latch 318 by pin 352. One end of spring 355 is hooked over the edge of mounting panel 34 and the other end is hooked over first trip latch arm 344 so as to bias first output lever latch 328 against output lever 312. A spring 354 provides bias to hold first main latch 318 against drive lever 310. Thus, surface 356 of first main latch 318 will engage first notch 324 of drive lever 310 when drive lever 310 is rotated counterclockwise to the spring-charged-to close position. The gap between surface 356 of first main latch 318 and notch 324 which is shown in FIG. 5 is overtravel that exists temporarily at the end of the charge cycle until torque is no longer applied by the charging means and drive lever 310 rotates back to cause notch 324 to engage surface 356.

Figure 6:
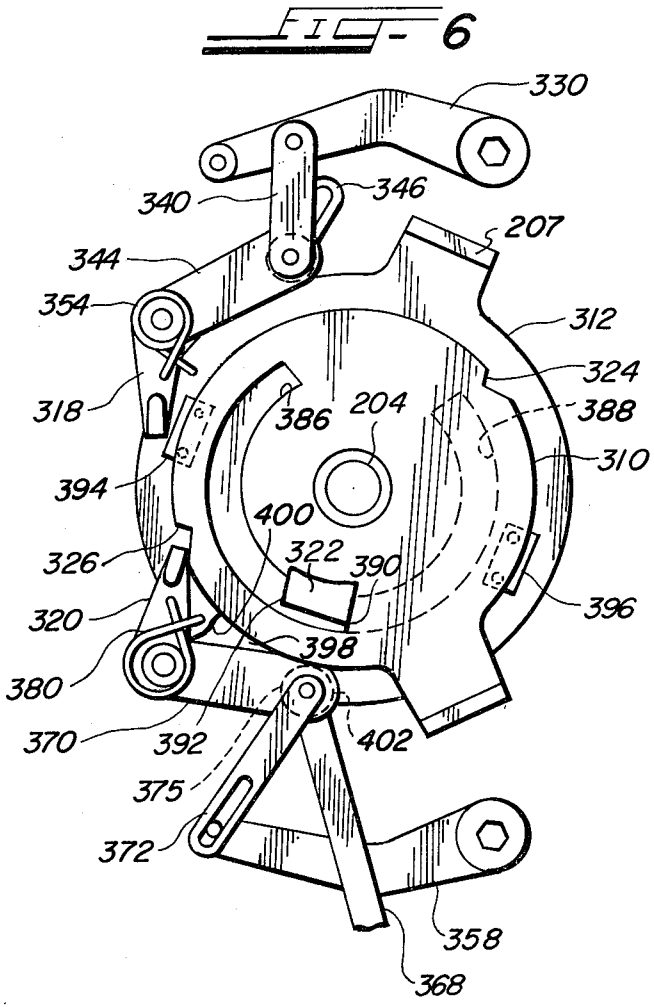
FIG. 6 is a view corresponding to FIG. 5 except showing the output lever and the drive lever in the spring-charged position ready for a switch opening operation.

Second actuating lever 358 of second output lever latch 360 is pivotably mounted on shaft 304. Actuating member 362 of second solenoid 306 is connected to coupler 364 by pin 363 and the other end of coupler 364 is pivotably connected to second link 368 by pin 366. Second link 368, second roller arm 370, and slotted link 372 are pivotably fastened by pin 374. Second roller 375 rotates freely about pin 374 and is engagable with surface 402 of notch 398 in output lever 312. The other end of slotted link 372 is slidably fastened to second actuating lever 358 and interconnecting link 346 by pin 376. The other end of second roller arm 370 is pivotably connected to second main latch 320 by pin 378. One end of spring 381 is hooked over the edge of mounting panel 34 and the other end is hooked over second roller arm 370 so as to bias second output lever latch 360 against output lever 312. A spring 380 provides bias to hold second main latch 320 against drive lever 310. Thus, surface 382 of second main latch 320 will engage second notch 326 of drive lever 310 when drive lever 310 is rotated clockwise to the spring-charged-to-open position. The gap between surface 382 of second main latch 320 and notch 326, which is shown in FIG. 6, is overtravel that exists temporarily at the end of the charge cycle until torque is no longer applied by the charging means and drive lever 310 rotates back to cause notch 326 to engage surface 382.

Figure 2:
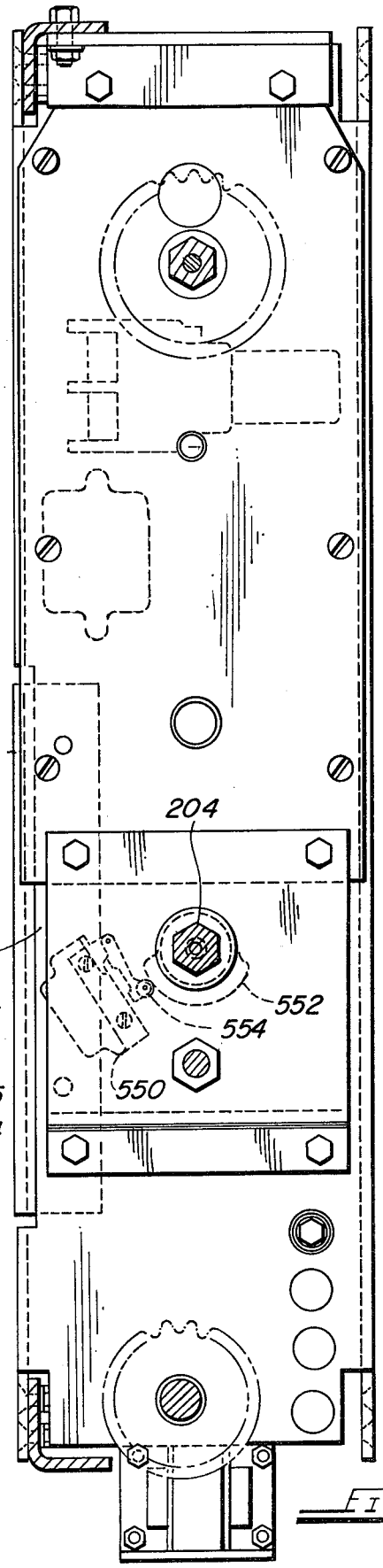
FIG. 2 is a cross-sectional view taken substantially along line B—B in FIG. 1.

With reference to FIGS. 1, 2 and 4, drive lever 310 is rigidly mounted near one end of main shaft 204 and rotates conjointly with main shaft 204. Thus, the rotation of main shaft 204 by the charging means comprised of a manual lever (not shown) operably fitted on the end of main shaft 204, or of gearbox assembly 100 driven by manually-operated crank 52 or motor 102, causes drive lever 310 to rotate. Main shaft 204, drive lever 310, output lever 312, and output shaft 222 are mounted coaxially.

With reference to FIG. 3, drive lever 310 contains arcuate slot 386 and output lever 312 contains congruent arcuate slot 388. Tang 323 of second spring arbor 322 projects into slots 386 and 388. Thus, the angular rotation of drive lever 310 and output lever 312 is limited in the clockwise direction by first surface 390 of tang 323 and in the counterclockwise direction by second surface 392 of tang 323.

Output lever 312 contains first cam 394 and second cam 396, which serve to nudge first main latch 318 and second main latch 320, respectively, outwardly from first notch 324 and second notch 326, respectively, in drive lever 310, thereby releasing drive lever 310 for rotation during recharging.

Output lever 312 is mounted on bushing 208 so that it rotates freely with respect to main shaft 204. Drive lever 310 is rigidly mounted on main shaft 204 by square key 210 so that main shaft 204 rotates conjointly with drive lever 310. Tang 206 on output lever 312 and tang 207 on drive lever 310 are engaged by first stop assembly 350 to limit their rotation and the rotation of first spring arbor 314 in the counterclockwise direction and by second stop assembly 384 to limit their rotation in a clockwise direction. First spring arbor 314 on spiral spring 220 is mounted on bushing 212 so that first spring arbor 314 and bushing 212 rotate freely on main shaft 204. Second spring arbor 322 is mounted on bushings 212 and 214 so that second spring arbor 322 and bushings 212 and 214 also rotate freely on main shaft 204. Spacer 216 maintains the proper axial separation between second spring arbor 322 and output lever 312. Bushing 218 in center channel 36 rotatably supports main shaft 204. Spacers 224 and 226 are located between bushing 328 and center channel 36. Output shaft 222 passes through spacer 232 and is supported by bushing 230 in rear channel 34 so as to rotate freely therein.

Spiral spring 220 is charged for a switch-closing operation by holding second spring arbor 322 stationary against the end of arcuate slot 388 in output lever 312 and rotating first spring arbor 314 counterclockwise by rotating drive lever 310 in the counterclockwise direction. Tang 207 on drive lever 310 opposes first spring arbor 314 and causes counterclockwise rotation of first spring arbor 314 when drive lever 310 is rotated in the counterclockwise direction. Spiral spring 220 is charged for a switch-opening operation by holding first spring arbor 314 stationary against tang 206 on output lever 312 and rotating second spring arbor 322 clockwise by rotating drive lever 310 clockwise. The end of arcuate slot 386 in drive lever 310 opposes second spring arbor 322 and causes clockwise rotation of second spring arbor 322 when drive lever 310 is rotated in the clockwise direction.

Figure 7:
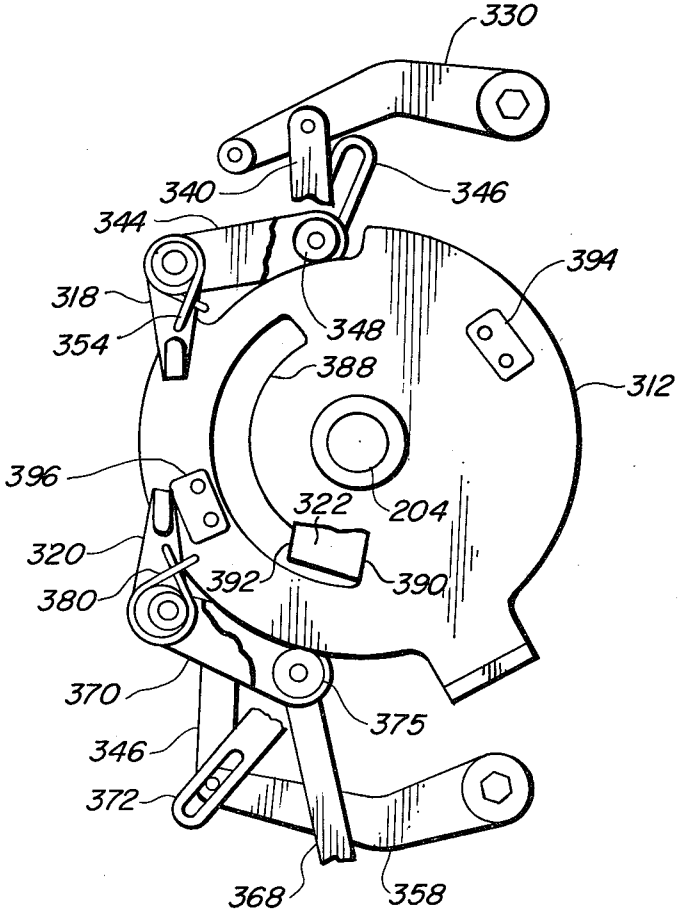
FIG. 7 is a view corresponding to FIG. 5 except showing the output lever in the switch-opened position with the spring discharged.

To charge latch trip assembly 300, drive lever 310 is rotated by means of main shaft 204 until spiral spring 220 is charged and drive lever 310 is latched in the charged position. FIG. 7 shows the position of spring arbor 322 and output lever 312 when the switch is open and spiral spring 220 is discharged. Thus, to charge spiral spring 220 for a switch closing operation, which requires a counter-clockwise rotation of output shaft 222 (viewed in the direction of FIG. 3), drive lever 310 is rotated counterclockwise by means of main shaft 204. When drive lever 310 is rotated counterclockwise approximately 120 degrees from its discharged position, arcuate slot 386 in drive lever 310 bottoms on surface 392 of tang 323 of second spring arbor 322 and first spring arbor 314 abuts against upper stop assembly 350 which prevents additional counterclockwise rotation of drive lever 318. In this position first notch 324 on drive lever 310 is opposite first main latch 318 and, since first main latch 318 is biased against drive lever 310 by spring 354, first main latch 318 will move into first notch 324. First main latch 318 in first notch 324 prevents clockwise rotation of drive lever 310, and therefore the energy imparted to spiral spring 220 by the rotation of main shaft 204 is caused to be stored therein by latch trip assembly 300. FIG. 5 shows the position of spring arbor 322, drive lever 310, and output lever 312 when the switch is open and spiral spring 220 is charged to close.

Figure 8:
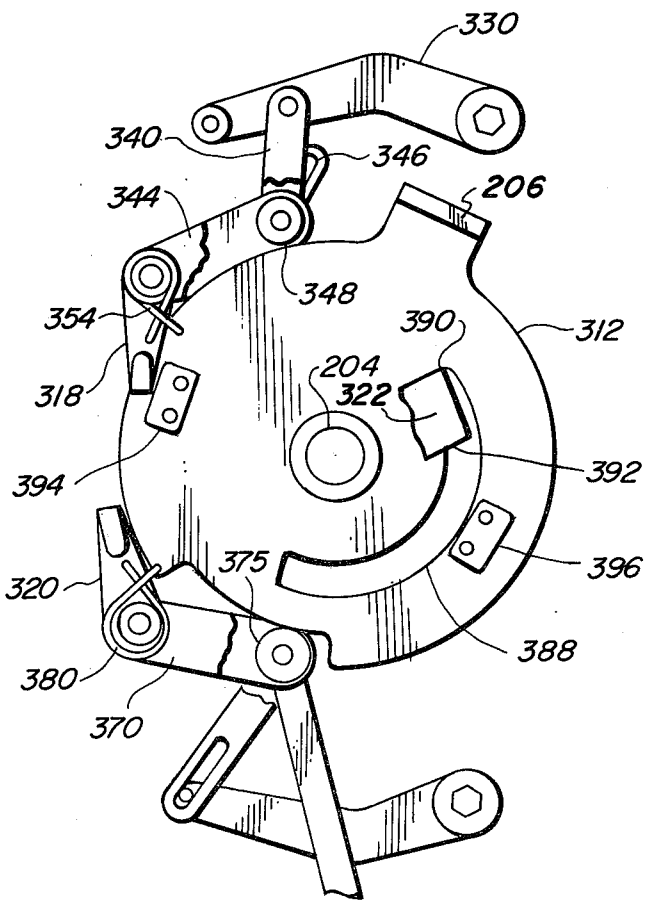
FIG. 8 is a view corresponding to FIG. 5 except showing the output lever in the switch closed position with the spring discharged.

Similarly, to charge spiral spring 220 for a switch-opening operation, which requires a clockwise rotation of output shaft 222, drive lever 310 is rotated clockwise by means of main shaft 204. FIG. 8 shows the position of spring arbor 322 and output lever 312 when the switch is closed and spiral spring 220 is discharged. When drive lever 310 is rotated clockwise approximately 120 degrees from its discharged position, arcuate slot 386 in drive lever 310 bottoms on surface 390 of tang 323 of second spring arbor 322 and first spring arbor 314 abuts against lower stop assembly 384 which prevents additional clockwise rotation of drive lever 310. In this position second notch 326 on drive lever 310 is opposite second main latch 320 and, since second main latch 320 is biased against drive lever 310 by spring 380, second main latch 320 will move into second notch 326. Second main latch 320 in second notch 326 prevents counter-clockwise rotation of drive lever 310, and, therefore, the energy imparted to spiral spring 220 by the rotation of main shaft 204 is caused to be stored therein by latch trip assembly 300. FIG. 8 shows the position of spring arbor 322, drive lever 310, and output lever 312 when the switch is closed and spiral spring 220 is discharged.

To trip latch trip assembly 300 manually, trip shaft 304 is rotated by means of trip handle 302, which is located on front panel 48 (see FIG. 17). When switch operating mechanism 10 is charged to close the switch, as shown in FIG. 5, tripping of latch trip assembly 300 and the releasing of the energy stored in spiral spring 220 is accomplished by rotating trip handle 302 clockwise, which causes trip shaft 304 to rotate clockwise. This motion moves second actuating lever 358 upward, which causes interconnecting link 346 to rotate first roller arm 344 counterclockwise about pin 352. Output lever 312, the rotation of which was opposed by the engagement of first roller 349 with surface 400 of notch 398, is thereby released to rotate counterclockwise along with output shaft 222 and the stored energy in spiral spring 220 is expended.

Figure 10:
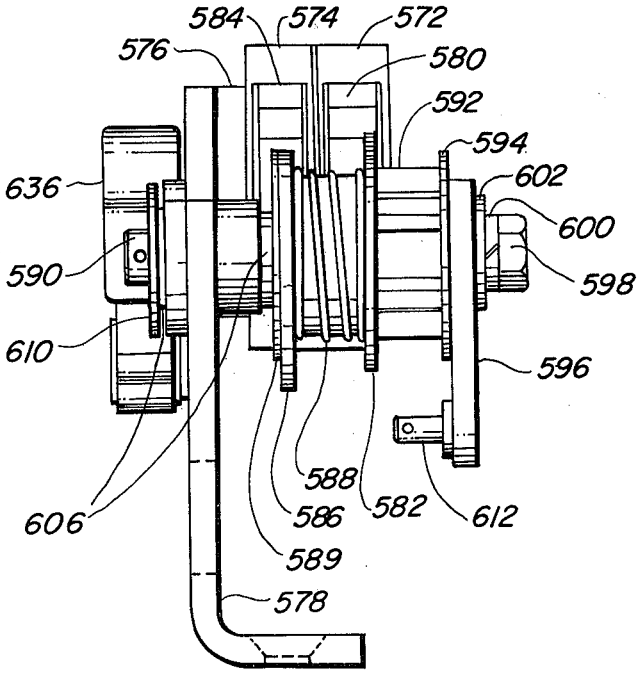
FIG. 10 is a side elevational view of the auxiliary switch shaft assembly.

Because of slot 373 in slotted link 372, second roller arm 370 and second roller 375 are not moved by this tripping operation, and, consequently, when output lever 312 has rotated counterclockwise sufficiently, second roller 375 drops into toggle lever notch 398 due to the bias provided by spring 381. Thus, second roller 375 is in position to engage surface 402 of notch 398 and to thereby prevent clockwise rotation of output lever 312 when switch operating mechanism 10 is subsequently charged for a switch-opening operation. FIG. 10 shows the position of output lever 312 and second roller 375 following a switch-closing operation with spiral spring 220 discharged.

When switch operating mechanism 10 is charged to open the switch, as shown in FIG. 6, latch trip assembly 300 is tripped and the energy stored in spiral spring 220 released by rotating trip shaft 304 counterclockwise by means of trip handle 302. Counterclockwise rotation of trip shaft 304 pulls second roller 375 out of output lever notch 398 so that surface 402 is no longer opposed by second roller 375, thereby releasing output lever 312 to rotate clockwise along with output shaft 222 and expending the stored energy in spiral spring 220.

Because of slot 347 in interconnecting link 346, first roller arm 344 and first roller 349 are not moved by this tripping operation, and, consequently, when output lever 312 has rotated clockwise sufficiently, first roller 349 drops into output lever notch 398 due to the bias provided by spring 355. Thus, first roller 349 is in position to engage surface 400 of notch 398 and to thereby prevent counterclockwise rotation of output lever 312 when switch operating mechanism 10 is subsequently charged for a switch-closing operation. FIG. 7 shows the position of output lever 312 and first roller 349 following a switch-opening operation with spiral spring 220 discharged.

Switch operating mechanism 10 can also be tripped electrically. With reference to FIG. 3 second output lever latch 360 is released electrically by means of second solenoid 306 for switch-opening operations, and first output lever latch 328 is released electrically by means of first solenoid 308 for switch closing operations. Thus, when first solenoid 308 is actuated, first roller arm 344 and first roller 349 are pulled upward through coupler 334 and first link 340, thereby releasing output lever 312 and expending the energy stored in sprial spring 220 as described above. Similarly, when second solenoid 306 is actuated, second roller arm 370 and second roller 375 are pulled downward through coupler 364 and second link 368. Due to slots 373 and 347, actuation of either solenoid effects movement of only its respectively asssociated output lever latch 360 or 328 and does not rotate trip shaft 304 or trip handle 302.

Figure 14:
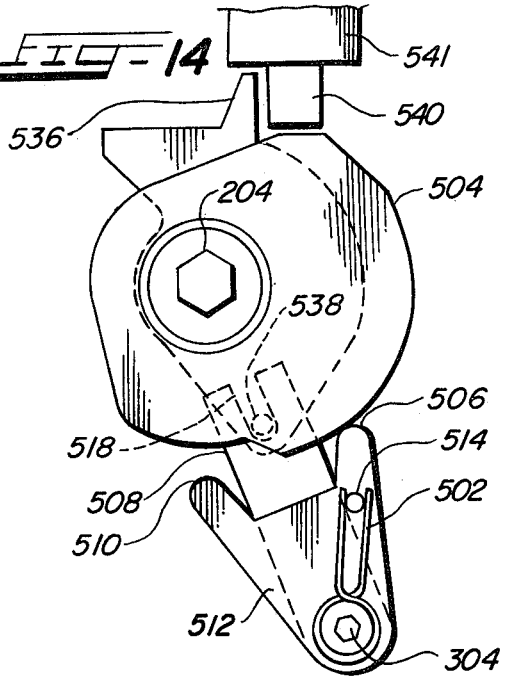
FIG. 14 is a cross-sectional partially fragmentary view showing the manual trip interlock assembly and the key bolt interlock assembly of the present invention.
Figure 15:
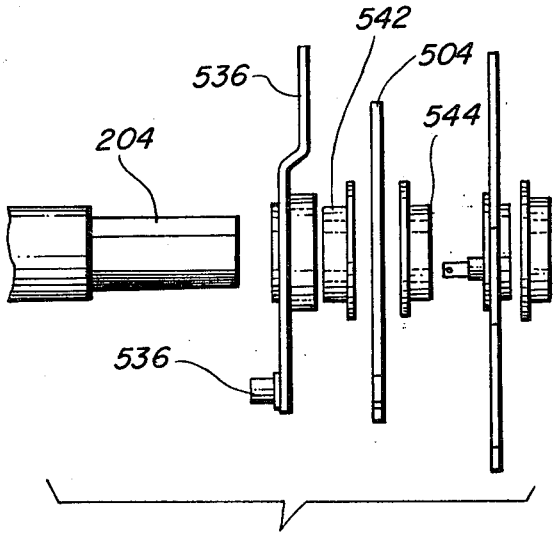
FIG. 15 is a side elevational view showing the main shaft and a portion of the manual trip interlock assembly.
Figure 16:
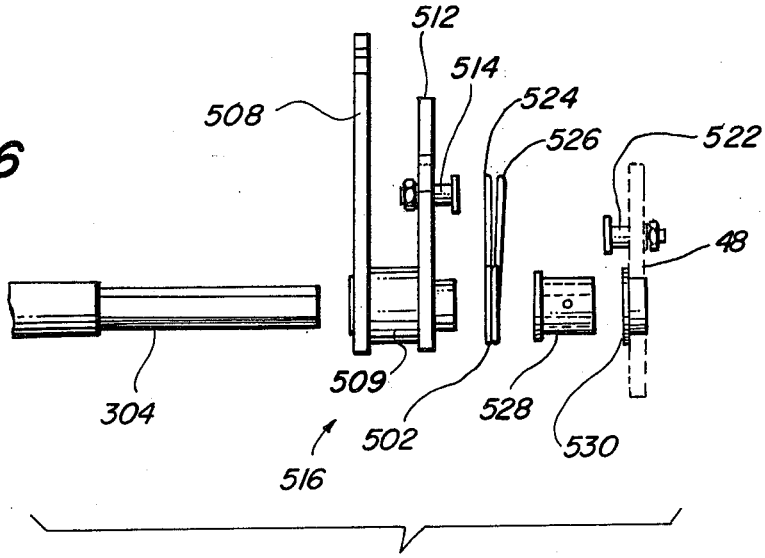
FIG. 16 is a side elevational view showing the trip shaft and a portion of the manual trip interlock assembly.

With reference to FIGS. 14, 15, and 16, manual trip interlock assembly 500 prevents manual tripping of switch operating mechanism 10 by rotation of trip handle 302 while spiral spring 220 is being charged. Control cam 536 is mounted on shaft 204 by bushing 542 to that control cam 536 rotates conjointly with main shaft 204. Pin 538 is suitably secured to control cam 536 and is engagable with notch 518 in lever 508. Interlock disk 504 is mounted on main shaft 204 by bushing 544 so that interlock disk 504 rotates conjointly with main shaft 204. Lever and yoke assembly 516 is comprised of lever 508, spacer 509, and yoke 512, all of which are rigidly mounted on trip shaft 304 so that lever 508 and yoke 512 rotate conjointly with trip shaft 304. Spring 502 is slidably mounted on hollow shaft 530 of lever and yoke assembly 516. Spring pin 514 is suitably secured to yoke 512 and is positioned between first member 524 and second member 526 of spring 502. Trip shaft 304 extends through front control panel 48 and is supported by hollow shaft 530 so that trip shaft 304 rotates freely with respect to control panel 48. Spring pin 522 is suitably secured in control panel 48 and extends behind control panel 48 in a position below spring pin 514. Thus, spring pins 514 and 522 are both engagable with members 524 and 526 of spring 502, and spring 502 provides bias in opposition to rotation of yoke 512 in either direction. Thus, lever and yoke assembly 516 is returned to the neutral position, shown in FIG. 16, following manual tripping of switch operating mechanism 10 by the rotation of trip shaft 304.

During charging of spiral spring 220 in the clockwise direction, interlock disk 504 rotates clockwise conjointly with main shaft 204 and the outer edge of interlock disk 504 provides mechanical interference with first appendage 506 of yoke 512. Therefore, counterclockwise rotation of yoke 512, and consequently of trip shaft 304, is prevented until interlock disk 504 has rotated to its extreme clockwise radial position. Thus, switch operating mechanism 10 cannot be tripped manually while being charged for a switch opening operation. When interlock disk 504 is rotated to its extreme clockwise radial position, spiral spring 220 is completely charged for a switch opening operation and the perimeter of interlock disk 504 nearest appendage 506 is relieved and does not engage appendage 510. Thus, when spiral spring 220 is charged, interlock disk 504 does not mechanically interfere with first appendage 506 of yoke 512 and manual tripping of switch operating mechanism 10 for a switch opening operation by rotation of trip handle 302 and trip shaft 304 is possible.

Similarly, during charging of spiral spring 220 in the counterclockwise direction for a switch-closing operation, interlock disk 504 rotates counterclockwise with main shaft 204 and the outer edge of interlock disk 504 provides mechanical interference with second appendage 510 of yoke 512. Therefore, clockwise rotation of yoke 512, and consequently of trip shaft 304, is prevented until interlock disk 504 has rotated to its extreme counterclockwise radial position. Thus, switch operating mechanism 10 cannot be manually tripped while being charged for a switch-closing operation. When interlock disk 504 is rotated to its extreme counterclockwise radial position, sprial spring 220 is completely charged for a switch-closing operation and the perimeter of interlock disk 504 nearest appendage 510 is relieved and does not engage appendage 510. Thus, when spiral spring 220 is charged, interlock disk 504 does not mechanically interfere with second appendage 510 of yoke 512, and manual tripping of switch operating mechanism 10 for a switch-closing operation by rotation of trip handle 302 and trip shaft 304 is possible.

Key locking unit 541 is rigidly mounted to control panel 48 so that when key locking unit 541 is operated by the insertion of a key (not shown) into an opening (not shown) in control panel 48, key interlock bolt 540 extends downward to a position that causes it to mechanically interfere with control cam 536 when control cam 536 is rotated clockwise, as illustrated in FIG. 14. Control cam 536 and main shaft 204 rotate coaxially. Since pin 538 engages notch 518 in lever 508, when key interlock bolt 540 is extended to prevent clockwise rotation of control cam 536, trip shaft 304 is prevented from rotating counterclockwise. Therefore, when key interlock bolt 540 is extended switch operating mechanism 10 cannot be manually tripped for a switch opening operation. By slight variations, the interlock provided by key locking unit 541 and cam 536 in the present invention can also be utilized to prevent the charging of switch operating mechanism 10 for a switch-closing operation or to prevent manual tripping of switch operating mechanism 10 for a switch-closing operation.

Referring to FIG. 2, disclosed is limit switch 550 which senses when spiral spring 220 is in the fully charged position. Cam 552 is rigidly mounted on main shaft 204 and rotates conjointly with shaft 204. Switch 550 is rigidly mounted to center channel 36 so that cam 552 is engagable with switch actuating member 554. Cam 552 is positioned on main shaft 204 with respect to actuating member 554 so that, in the spring discharged position, cam 552 is centered in actuating member 554 and is engaging actuating member 554. Rotation of main shaft 204 in either direction to charge spiral spring 220 causes cam 552 to pivot also. After rotation of main shaft 204 in either direction to the fully charged position, cam 552 no longer engages actuating member 554. Thus, the release of actuating member 554 indicates that spiral spring 220 is fully charged. Through appropriate circuitry, switch 550 prevents actuation of first and second solenoids 306 and 308 during a recharging cycle.

Figure 11:
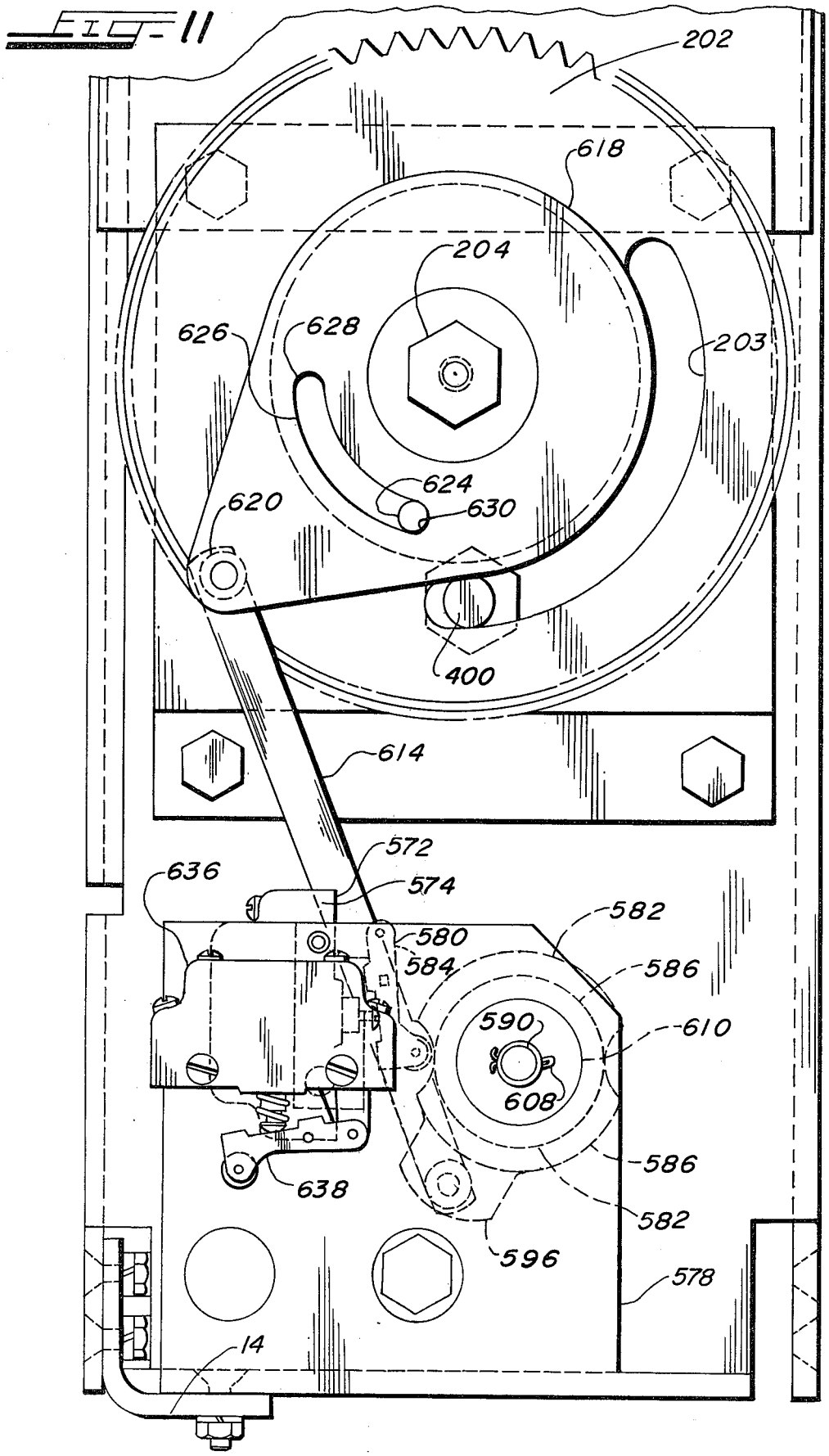
FIG. 11 is a cross-sectional view taken substantially along line C—C in FIG. 1 showing the auxiliary switch shaft assembly.

With reference to FIGS. 1, 10, and 11, auxiliary switch assembly 570 is disclosed. First lost motion spring position limit switch 572 and second lost motion spring position limit switch 574 are actuated when switch operating mechanism 10 has been charged to open and charged to close, respectively. Switches 572 and 574 are rigidly mounted on mounting bar 576 which is secured to mounting bracket 578. Mounting bracket 578 is suitably secured to bottom frame angle 14. Switch actuating member 580 of first switch 572 is engagable with first cam 582, and switch actuating member 584 of second switch 574 is engagable with second cam 586. First and second cams 582 and 586 are separated by spring 588 on shaft 590. Adjacent to cam 582 on shaft 590 are mounted spacers 592 and 594 and first lever 596. Head 598 on shaft 590 bears against washers 600 and 602 on one end of shaft 590. Spacer 604 is mounted adjacent second cam 586 on shaft 590, which passes through bushing 606 and rotates freely in bushing 606. Bushing 606 is mounted in mounting bracket 578. Cotter pin 608 which bears against washer 610 prevents shaft 590 from sliding out of bushing 606 and mounting frame 578. First and second cams 582 and 586 rotate conjointly with first lever 596 and are pivotably mounted on shaft 590. The bias provided by spring 588 prevents first and second cams 582 and 586 and lever 596 from freely rotating on shaft 590 and assures that at least a minimal amount of torque is required to pivot lever 596 along with first and second cams 582 and 586.

Suitably secured to the end of lever 596 is pin 612 on which one end of interconnecting lever 614 is pivotably mounted. Cotter pin 616 prevents interconnecting lever 614 from sliding off pin 612. The other end of interconnecting lever 614 is pivotably secured to second lever 618 by pin 620 and cotter pin 622. Second lever 618 is pivotably mounted on main shaft 204. Tang 624, which is rigidly secured to sprocket 202, extends into arcuate slot 626 in second lever 618. As described above, sprocket 202 is rigidly mounted on main shaft 204 and rotates conjointly with main shaft 204, the rotation of sprocket 202 being limited by the mechanical interference between the ends of arcuate slot 203 in sprocket 202 with sprocket stop stud 40. Arcuate slot 203 is sufficiently long to allow rotation of drive lever 310 in either direction slightly beyond its latched position. Rotation of drive lever 310 slightly past its latched position assures that latching indeed occurs.

With reference to FIG. 11, arcuate slot 626 in second lever 618 subtends a smaller angle than slot 203. Thus, while tang 624 slides along arcuate slot 626 as sprocket 202 rotates during each recharging cycle, tang 624 engages end 628 or 630 near the point of rotation in each recharging cycle at which drive lever 310 becomes latched. The engagement of tang 624 with end 628 or 630 causes second lever 618 to pivot during the end of the recharging cycle. Through interconnecting lever 614 and first lever 596, therefore, first and second cams 582 and 586 are rotated during the end portion of each recharging cycle. First cam 582 is positioned with respect to first lever 596 on shaft 590 such that when the rotation of sprocket 202 is in the clockwise direction to charge spiral spring 220 for a switch-opening operation, first cam 582 is rotated so as to engage and actuate actuating lever 580 of first lost motion spring position limit switch 572. FIG. 11 shows the position of sprocket 202 and second lever 618 at the start of a recharging cycle for a switch-opening operation. Actuation of switch 572, through appropriate circuitry, causes motor 102 to stop and consequently, causes the rotation of sprocket 202 to stop. Similarly, second cam 586 is positioned with respect to first lever 596 on shaft 590 such that when the rotation of sprocket 202 is in the counterclockwise direction to charge spiral spring 220 for a switch-closing operation, second cam 586 is rotated so as to engage and actuate actuating lever 584 of second lost motion spring position limit switch 574. Actuation of switch 574, through appropriate circuitry, causes motor 102 to stop and, consequently, causes the rotation of sprocket 202 to stop.

Spring bias provided by spring 588 provides bias outwardly along shaft 590. The resultant snug relationship between spacer 589, second cam 586, spring 588, first cam 582, spacers 592 and 594, and first lever 602 prevents first lever 596 and first or second cams 582 and 586 from rotating unless at least a minimal amount of torque is applied by second lever 618. Thus, rotation so as to permit disengagement with switch actuating member 580 or 584, respectively, which would cause motor 102 to start again, is prevented until torque is applied by the rotation of sprocket 202 in the opposite direction during the subsequent charging operation.

Limit switch 636 is rigidly mounted on mounting bracket 578 and is operably connected to shutter 50 (see FIG. 17), such that whenever shutter 50 is pivoted to allow insertion of manually operated crank 52 and the charging of spiral spring 220 manually switch actuating member 638 of switch 636 is actuated. Actuation of switch 636, through appropriate circuitry, prevents motor 102 from operating. This inerlock feature prevents the possibility of motor 102 starting while spiral spring 220 is being charged manually.

In certain applications, automatic recharging of spiral spring 220 by means of motor 102 is not required. For these applications a variation in the preferred embodiment of the present invention is provided that is identical to the invention as described above except that motor 102, gearbox assembly 100, and the manually operated crank means for recharging spiral spring 220 via shaft 106 are omitted. Charging of spiral spring 220 is accomplished by rotating main shaft 204 directly by means of a lever (not shown) that is engagable with main shaft 204 through opening 56 in control panel 48 (see FIG. 17). A lever having a longer moment arm than manually operated crank 52 is used since greater torque is required to directly charge spiral spring 220 without gearbox assembly 100. Since in applications are requiring automatic recharging of spiral spring 220 by means of motor 102, it is unlikely that switch operating mechanism 10 would be intended to trip automatically for both switch-closing and switch-opening operations, in this variation of the present invention either first or second solenoids 306 or 308 may normally be omitted also.

Figure 9:
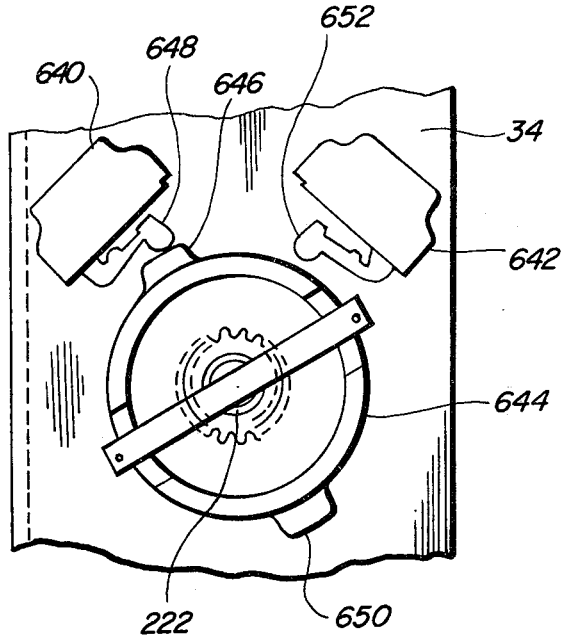
FIG. 9 is a cross-sectional partially fragmentary view showing the operator position limit switches and the output coupling of the present invention.

With reference to FIG. 9, rigidly mounted on rear channel 34 are first and second operator position limit switches 640 and 642. Output coupling 644 is rigidly mounted on output shaft 222 and rotates conjointly with output shaft 222. Output coupling member 644 contains first cam 646 which engages actuating member 648 of first limit switch 640 only when switch operating mechanism 10 is in the switch-closed position, thereby depressing actuating member 648 to actuate first limit switch 640. Similarly, output coupling member 644 contains second cam 650 which engages actuating member 652 of second limit switch 642 only when switch operating mechanism 10 is in the switch-opened position, thereby depressing actuating member 652 to actuate second limit switch 642.

First and second operator position limit switches 640 and 642 thus sense whether switch operating mechanism 10 is in the switch-closed or switch-opened position, respectively. First and second switches 640 and 642, in cooperation with appropriate circuitry, cause motor 102 to rotate motor pinion 103 in the proper direction to recharge spiral spring 220 for the subsequent switch operation, i.e., motor 102 rotates so as to charge switch operating mechanism 10 to open when first operator position limit switch 640 is actuated and rotates so as to charge switch operating mechanism 10 to close when second operator position limit switch 642 is actuated.

It should be expressly understood that various changes and modifications can be made to the present invention as illustrated herein without departing from the spirit and scope of the preent invention as defined in the appended claims.

We claim:

1. An improved mechanism for operating a switch from the opened to closed or from the closed to opened positions comprising:

a rotatably mounted output lever operably connected to the switch;

a rotatably mounted drive lever rotatable about the same axis as said output lever;

spring means coaxial with and interconnecting said output lever and said drive lever;

first output lever latch means for releasably holding said output lever in the switch-opened position;

second output lever latch means for releasably holding said output lever in the switch-closed position;

charging means connected to said drive lever for rotating said drive lever in a first direction to charge said spring means for switch closing and in a second direction to charge said spring means for switch opening;

first main stop latch means for engaging and holding said drive lever in a spring-charged position for switch closing when said charging means has rotated said drive lever in the first direction;

second main stop latch means for engaging and holding said drive lever in a spring-charged position for switch opening when said charging means has rotated said drive lever in the second direction;

a pivotably mounted trip lever operably connected to said first and second output lever latch means for causing said first output lever latch means to release said output lever so that said output lever will rotate under the bias of said spring means to close the switch when said trip lever is pivoted in a first direction, and for causing said second output lever latch means to release said output lever so that said output lever will rotate under the bias provided by said spring means to open the switch when said trip lever is pivoted in a second direction.

2. An improved mechanism, as claimed in claim 1, wherein said charging means comprises an electric motor.

3. An improved mechanism, as claimed in claim 1, wherein said charging means further comprises gearbox means for reducing the torque required to charge said spring means and for preventing the application of excessive torque to said charging means, said drive lever, or said spring means.

4. An improved mechanism, as claimed in claim 1, wherein said charging means comprises a manually operated crank means.

5. An improved mechanism, as claimed in claim 1, wherein said charging means is connected to electric driving means and to manual driving means and driven either electrically or manually to charge said spring means, and further comprising a shutter and a limit switch operably connected to said shutter for preventing said charging means from being driven electrically while being driven manually.

6. An improved mechanism, as claimed in claim 1, further comprising:

first solenoid means operably connected to said first output lever latch means for causing said first output lever latch means to release said output lever in response to a first electrical control signal; and second solenoid means operably connected to said second output lever latch means for causing said second output lever latch means to release said output lever in response to a second electrical control signal.

7. An improved mechanism, as claimed in claim 6, further comprising:

a position sensing means for sensing whether said spring means is fully charged; said position sensing means being operably connected to said first and second solenoids to cause said first or second solenoid not to release said output lever in response to a first or second electrical control signal except when said spring means is fully charged.

8. An improved mechanism, as claimed in claim 1, wherein said first and second output lever latch means comprise:

first and second roller means for engaging said output lever;

interconnecting link means operably connected to said first roller means; and wherein said trip lever is a pivotably mounted, manually operated trip lever operably connected to said interconnecting link means and said first roller means for manually causing said first roller means to disengage said output lever when said trip lever and said interconnecting link means are pivoted in a first direction so that said output lever and the output shaft can rotate under the bias of said spiral spring in a first direction, and for manually causing said second roller means to disengage said output lever when said trip lever is pivoted in a second direction so that said output lever and the output shaft can rotate under the bias of said spiral spring in a second direction.

9. An improved mechanism, as claimed in claim 7, wherein said position sensing means comprises:

a limit switch rigidly mounted;

an actuating member operably connected to said limit switch, said limit switch being in a first state when said actuating member is held in a first position, and said limit switch being in a second state when said actuating member is not being held in the first position; and a cam operably connected to said charging means so as to rotate conjointly with said charging means, said cam being adapted to engage said actuating member of said limit switch and to hold said actuating member in the first position while said charging means is rotating to charge said spring means, said cam being adapted to not engage said actuating member when said charging means is rotated to the spring-charged position, whereby said limit switch is held in a first state except when said spring means is fully charged.

10. An improved mechanism, as claimed in claim 1, further comprising:

a pivotably mounted yoke lever operably connected to said trip lever so as to pivot conjointly with said trip lever, said yoke lever having a first appendage and a second appendage; and a rotatably mounted interlock disk operably connected to said charging means so as to rotate conjointly with said charging means, said interlock disk being adapted to interfere with the first appendage of said yoke lever while said charging means is rotating in a first direction thereby preventing said trip lever from being pivoted in a first direction to release said first output lever latch means, and said interlock disk being adapted to interfere with the second appendage of said yoke lever while said charging means is rotating in a second direction, thereby preventing said trip lever from being pivoted in a second direction to release said second output lever latch means, whereby said trip lever is not operable to trip the switch operating mechanism unless said spring means is in the completely charged position.

11. An improved mechanism, as claimed in claim 10, further comprising:

a first spring pin rigidly mounted on said yoke lever;

a second spring pin rigidly mounted in a stationary position; and a spring having its ends extending outward substantially parallel to each other, said spring being mounted so that its ends are in a plane substantially perpendicular to said first spring pin and said second spring pin, the ends of said spring being adapted to have positioned between them said first spring pin and said second spring pin, whereby whenever said first spring pin and said yoke lever pivot, said first spring pin engages one end of said spring and said second spring pin engages the other end of said spring thereby providing spring bias to oppose pivoting of said yoke lever away from a neutral position in which said trip lever is not operable to trip the switch operating mechanism.

12. An improved mechanism, as claimed in claim 1, further comprising:

a rotatably mounted control cam;

a pin rigidly mounted on said control cam;

a key locking means having a locked position and an unlocked position;

a bolt operably connected to said key locking means, said bolt being adapted to extend to a position that mechanically interferes with the rotation of said control cam when said key locking means is in the locked position, and said bolt being adapted to not mechanically interfere with the rotation of said control cam when said key locking means is in the unlocked position; and a pivotably mounted lever operably connected to said trip lever so as to pivot conjointly with said trip lever, said pivotably mounted lever being adapted to engage said pin thereby causing said control cam to rotate when said pivotably mounted lever pivots, whereby operation of said trip lever is prevented when said key locking means is in the locked position.

13. An improved mechanism, as claimed in claim 1, wherein said first and second output lever latch means comprise:

a first actuating lever pivotably mounted at a first end thereof;

a first roller link pivotably mounted at a first end thereof to the second end of said first actuating lever;

an interconnecting link having a slot near a first end thereof;

a first pin mounted in the second end of said first roller link, said first pin adapted to slide in the slot in said interconnecting link and engage said interconnecting link when said output lever is in the switch-opened position;

a first roller rotatably mounted on said first pin, said first roller adapted to engage said output lever when said output lever is in the switch-opened position;

a second actuating lever operably connected at a first end thereof to said trip lever so as to pivot conjointly with said trip lever, said second actuating lever pivotably connected at the second end to the second end of said interconnecting link;

a slotted link having a slot near a first end thereof;

a second roller rotatably mounted in the second end of said slotted link, said second roller adapted to engage said output lever when said output lever is in the switch-closed position;

a second pin mounted in the second end of said second actuating lever, said second pin adapted to slide in the slot in said slotted link and engage said slotted link when said output lever is in the switch-closed position;

whereby when said output lever is in the switch-opened position, pivoting said trip lever in a first direction causes said second actuating lever and said interconnecting link to pivot in a first direction thereby causing said second pin to slide in the slot in said slotted link and causing said first pin to engage said interconnecting link thereby causing said first roller to disengage said output lever, and whereby when said output lever is in the switch-closed position, pivoting said trip lever in the second direction causes said second actuating lever and said interconnecting link to pivot in a second direction thereby causing said first pin to slide in the slot in said interconnecting link and causing said second pin to engage said slotted link thereby causing said second roller to disengage said output lever.

14. An improved mechanism, as claimed in claim 13, further comprising:

first solenoid means operably connected to said first roller for causing said first roller to disengage said output lever in response to a first control signal; and second solenoid means operably connected to said second roller for causing said second roller to disengage said output lever in response to a second control signal.

15. An improved mechanism, as claimed in claim 3, wherein said gearbox means comprises:

a shaft;

first gear means for causing said shaft to rotate when said first gear means rotates;

manually operated crank means for causing said first gear means to rotate and to thereby cause said shaft to rotate;

second gear means for causing said shaft to rotate when said second gear means rotates;

electric motor means for automatically causing said second gear means to rotate and to thereby cause said shaft to rotate in response to a switch opening or switch closing operation;

drive means adapted to rotate said spring means when said drive means rotates, thereby charging said spring means; and torque limiting means for translating rotation from said shaft to said drive means, said torque limiting means limiting the amount of torque applied to said drive means by not translating rotation from said shaft to said drive means when the torque applied to said torque limiting means by said shaft exceeds a predetermined amount.

16. An improved mechanism for operating a switch from the opened to closed or from the closed to opened positions comprising:

a rotatably mounted output lever operably connected to the switch;

a rotatably mounted drive lever rotatable about the same axis as said output lever;

spring means coaxial with and interconnecting said output lever and said drive lever;

first roller means for releasably holding said output lever in the switch-opened position;

second roller means for releasably holding said output lever in the switch-closed position;

charging means connected to said drive lever for rotating said drive lever in a first direction to charge said spring means for switch closing and in a second direction to charge said spring means for switch opening;

first main stop latch means for engaging and holding said drive lever in a spring-charged position for switch closing when said charging means has rotated said drive lever in the first direction;

second main stop latch means for engaging and holding said drive lever in a spring-charged position for switch opening when said charging means has rotated said drive lever in the second direction;

gearbox means for reducing the torque required to charge said spring means;

torque limiting means for preventing the application of excessive torque by said charging means operating in cooperation with said gearbox means;

trip means operably connected to said first and second roller means for causing said first roller means to release said output lever so that said output lever will rotate under the bias of said spring means to close the switch, and for causing said second roller means to release said output lever so that said output lever will rotate under the bias provided by said spring means to open the switch.

* * * * *